US008109044B2

(12) United States Patent
Graber

(10) Patent No.: US 8,109,044 B2
(45) Date of Patent: Feb. 7, 2012

(54) OUTDOOR SHOWER ENCLOSURE KIT

(75) Inventor: Loren R. Graber, Nappanee, IN (US)

(73) Assignee: Digger Specialties, Inc., Bremen, IN (US)

( * ) Notice: Subject to any disclaimer, the term of this patent is extended or adjusted under 35 U.S.C. 154(b) by 344 days.

(21) Appl. No.: 12/426,625

(22) Filed: Apr. 20, 2009

(65) Prior Publication Data

US 2009/0260151 A1 Oct. 22, 2009

Related U.S. Application Data

(60) Provisional application No. 61/046,616, filed on Apr. 21, 2008.

(51) Int. Cl.
*E04H 1/12* (2006.01)
*A47K 3/28* (2006.01)
*A47K 3/32* (2006.01)

(52) U.S. Cl. ..... 52/36.2; 52/79.1; 52/79.5; 52/79.12; 4/599; 4/600; 4/612; 4/614; 135/902

(58) Field of Classification Search ..... 52/36.2, 52/79.1, 79.5, 79.12, 264, 270; 4/599, 600, 4/612, 614; 135/902
See application file for complete search history.

(56) References Cited

U.S. PATENT DOCUMENTS

| | | | | |
|---|---|---|---|---|
| 1,857,913 | A * | 5/1932 | Judelson | 52/262 |
| 2,519,430 | A * | 8/1950 | Brown | 135/156 |
| 3,080,568 | A * | 3/1963 | Burnett | 4/602 |
| 3,688,458 | A * | 9/1972 | Aubrey et al. | 52/280 |
| 4,018,016 | A * | 4/1977 | Zale | 52/79.1 |
| 4,065,885 | A * | 1/1978 | Blick et al. | 52/143 |
| 4,807,310 | A | 2/1989 | Sedala | |
| 4,975,992 | A * | 12/1990 | Patterson et al. | 4/599 |
| 4,993,201 | A * | 2/1991 | Bunyard | 52/35 |
| 5,287,569 | A * | 2/1994 | Johnson | 4/599 |
| 5,293,725 | A * | 3/1994 | Matticks et al. | 52/271 |
| 5,331,778 | A | 7/1994 | Mazpule et al. | |
| 5,511,254 | A * | 4/1996 | O'Brien | 4/532 |
| 5,544,369 | A * | 8/1996 | Roberts | 4/599 |
| 5,970,536 | A * | 10/1999 | Suarez | 4/599 |
| 6,701,678 | B1 * | 3/2004 | Skov et al. | 52/79.9 |
| 6,786,009 | B1 * | 9/2004 | McGunn et al. | 52/36.2 |
| 6,802,158 | B1 * | 10/2004 | Greene | 52/79.5 |
| 6,892,497 | B2 * | 5/2005 | Moon et al. | 52/79.1 |
| 7,104,221 | B2 * | 9/2006 | Simon | 119/498 |
| 2005/0279034 | A1 * | 12/2005 | Tsang | 52/79.1 |

FOREIGN PATENT DOCUMENTS

EP 0 565 497 A * 10/1993

* cited by examiner

*Primary Examiner* — Robert Canfield
(74) *Attorney, Agent, or Firm* — Barnes & Thornburg LLP

(57) ABSTRACT

An outdoor shower enclosure that may include a roof and a base frame having a plurality of metal structural members that are connected together to define a peripheral edge with a plurality of mounting plates. A plurality of substantially vertically extending support posts may be provided that extend between the mounting plates and the roof. In some cases, the support posts may be spaced apart approximately equidistant from each other along the peripheral edge. The shower enclosure may include a plurality of vinyl wall panels disposed between the posts. In some cases, a vinyl floor panel could be carried by the base frame.

10 Claims, 15 Drawing Sheets

OUTDOOR SHOWER ENCLOSURE KIT

RELATED APPLICATION

This application claims the benefit of U.S. Provisional Application Ser. No. 61/046,616 filed Apr. 21, 2008, the entire disclosure of which is hereby incorporated by reference.

TECHNICAL FIELD

This disclosure relates generally to an outdoor shower enclosure; in particular, the disclosure relates to an outdoor shower enclosure kit that provides easy installation and may be arranged in various configurations.

BACKGROUND

Natural disasters, such as hurricanes, tornados, and wild fires, rage devastation on numerous people every year. In extreme cases, these disasters displace thousands of people from their homes. This creates an immediate and urgent need to provide basic necessities for these people, such as food, water, medicine, and bathroom facilities. Although portable restrooms are often provided, there is typically no place to take a shower in the devastated area.

In other circumstances, such as in a home's backyard, at parks, beaches, etc., it may be desirable to provide an outdoor shower. Although certain types of outdoor showers are available, these showers require a choice between privacy or ease of installation. In some cases, for example, outdoor showers consist of an elevated shower head attached to a source of water, without any enclosure to provide privacy. Enclosures for outdoor showers can provide privacy, but are difficult to install and require customization.

SUMMARY

According to one aspect, the invention provides a modular outdoor shower enclosure system. The system may include at least one roof, a first base frame and a second base frame. Typically, the first and second base frames define a rectangular peripheral edge with mounting plates to which a plurality of elongated posts are mountable. A plurality of wall panels and/or door may be mounted between the posts. When the first base frame is used, the roof, the wall panels, and the posts are adapted to form a single shower stall that defines a rectangular parallelepiped. When the second base frame is used, the roof, the wall panels, and the posts are adapted to form multiple shower stalls that each define a rectangular parallelepiped.

In some embodiments, the mounting plates in the first base frame and the second base frame have an approximate equidistant spacing so that the wall panels and the door can be interchangeably mounted using either the first base frame or the second base frame. Embodiments are contemplated in which the mounting plates could include a predefined hole to receive a fastener for attaching the posts to the mounting plates. In some cases, a plurality of floor panels could be dimensioned to be interchangeably used with both the first base frame and the second base frame. For example, the floor panels could include at least one elongated support member that reduces lateral movement. By way of another example, the floor panels could include a cut-out portion that is dimensioned to receive at least a portion of the posts.

Depending upon the exigencies of the circumstances, the parts could be formed from various types of materials. In some embodiments, the roof may include a translucent portion and/or a louvered portion. Embodiments are contemplated in which the first base frame and/or the second base frame could be formed of metallic material. For example, the first and second base frames could be formed of a powder coated metal. In some cases, the wall panels could be vinyl panels, such as PVC panels.

According to another aspect, the invention provides an outdoor shower enclosure. The shower enclosure may include a roof and a base frame having a plurality of metal structural members that are connected together to define a peripheral edge with a plurality of mounting plates. A plurality of substantially vertically extending support posts may be provided that extend between the mounting plates and the roof. In some cases, the support posts may be spaced apart approximately equidistant from each other along the peripheral edge. The shower enclosure may include a plurality of vinyl wall panels disposed between the posts. In some cases, a vinyl floor panel could be carried by the base frame.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only in which.

Figure 1:
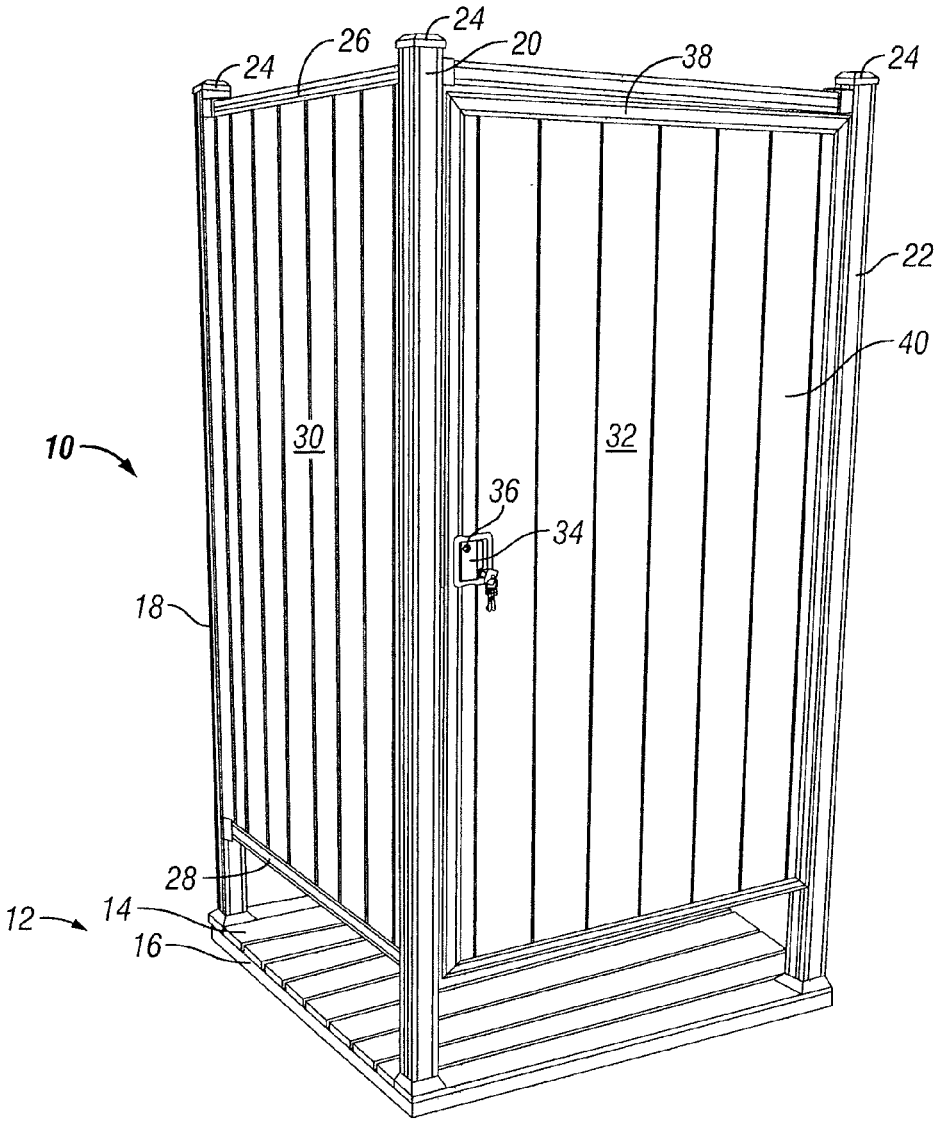
FIG. 1 is a front, perspective view of an outdoor shower enclosure with a single stall according to an embodiment of the invention.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

FIG. 1 shows an example outdoor shower enclosure 10 according to an embodiment of the present invention. In the embodiment shown, the enclosure 10 includes a base portion 12 with a floor 14 supported on a base frame 16. A first post 18, a second post 20, a third post 22 and a fourth post (not shown in FIG. 1) extend upwardly from the base frame 16. In this example, a proximate end of the posts 18, 20, 22 is coupled with the edges of the base frame 16. A distal end of the posts 18, 20, 22 includes an end cap 24 to prevent water from flowing into the post. A top rail 26 and a bottom rail 28 extend between and are attached to the first post 18 and the second post 20 to hold a wall panel 30. In some cases, the base portion 12, posts 18, 20, 22, top rail and bottom rail are all formed from powder coated aluminum. It should be appreciated, however, that other suitable materials could be used. In some embodiments, the wall panel 30 is formed from a vinyl panel, such as PVC. Embodiments are contemplated in which the floor 14 is formed from a foamed vinyl.

In the example shown in FIG. 1, the enclosure 10 includes a door 32 pivotally mounted to the third post 22, using a hinge, such as a piano hinge. As shown, a latch 34 allows the door 32 to be selectively opened and closed. In some cases, such as in the example shown, the latch 34 may include a lock 36. In this example, the door 32 includes an edge portion 38 surrounding a door panel 40. Typically, the edge portion 38 may be formed from a metallic material, such as powder coated aluminum, while the door panel may be formed from a vinyl panel, such as PVC. Preferably, the door 32 and wall panels 30 are dimensioned substantially the same so as to be interchangeably mounted as desired. This allows a wide variety of arrangements, such as shown in FIGS. 17-29.

Figure 2:
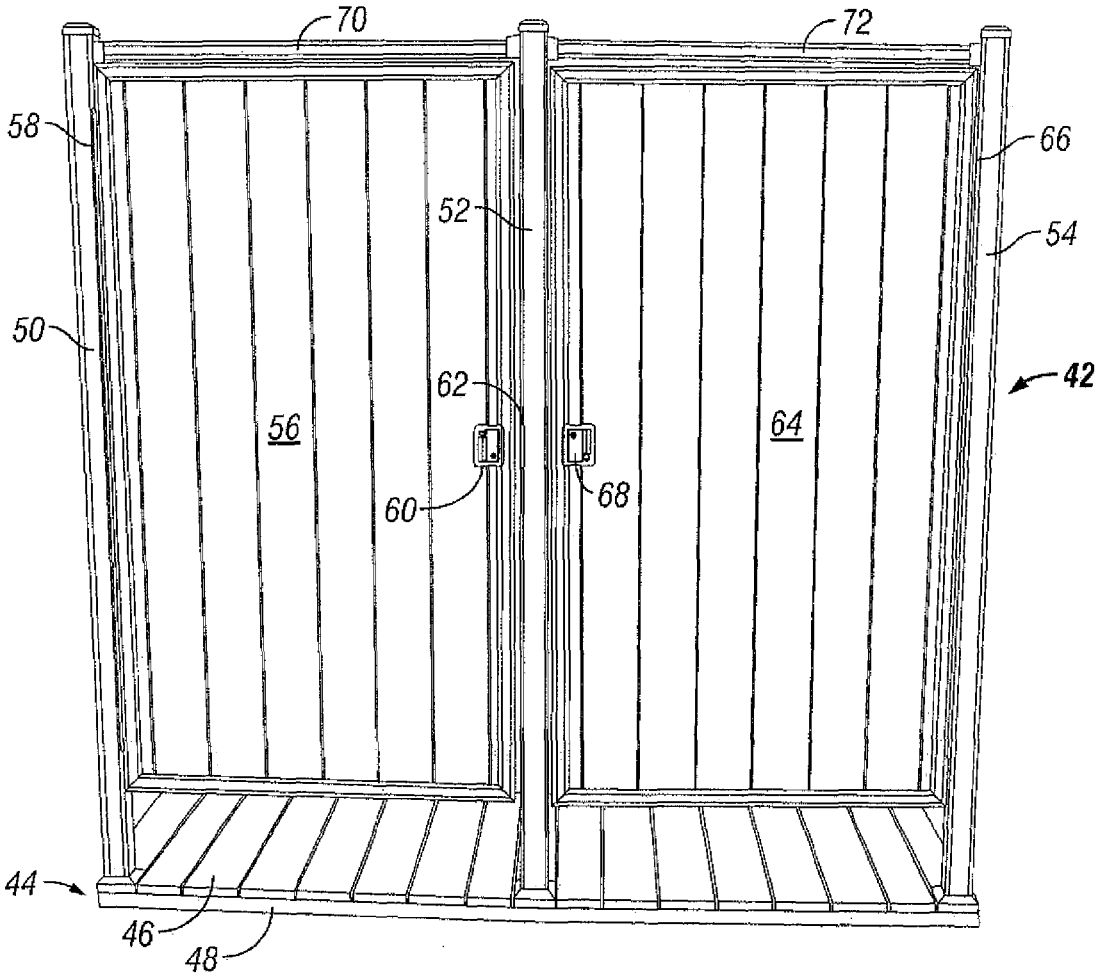
FIG. 2 is a front view of an outdoor shower enclosure with a double stall according to an embodiment of the invention.

FIG. 2 shows an enclosure 42 according to an alternative embodiment of the present invention. In this embodiment, the enclosure includes two stalls to be used. As shown, the enclosure 42 includes a base portion 44 with a floor 46 supported by a base frame 48. In this example, the enclosure 42 includes a first post 50, a second post 52, and a third post 54 extending from the base frame 48 (other posts may be included, but are not shown in this Figure). As shown, the posts 50, 52, 54 are spaced equal distance so that similarly sized doors and wall panels can be mounted therebetween. In the example shown, a first door 56 is pivotally mounted using a hinge 58 to the first post 50. A latch 60 interfaces with a spacer 62 mounted to the second post 52. The use of spacer 62 allows the latch 60 to engage a hole (not shown) in the spacer 62 without requiring a hole be formed in the second post 52. A second door 64 is pivotally mounted in this example to the third post 54 using a hinge 66. A latch 68 allows the second door 64 to be selectively opened and closed about the hinge 66. In the example shown, a top rail 70 is disposed between the first post 50 and the second post 52, while another top rail 72 is disposed between the second post 52 and the third post 54. The top rails 70, 72 provide additional structural support for the enclosure 42.

Figure 3:
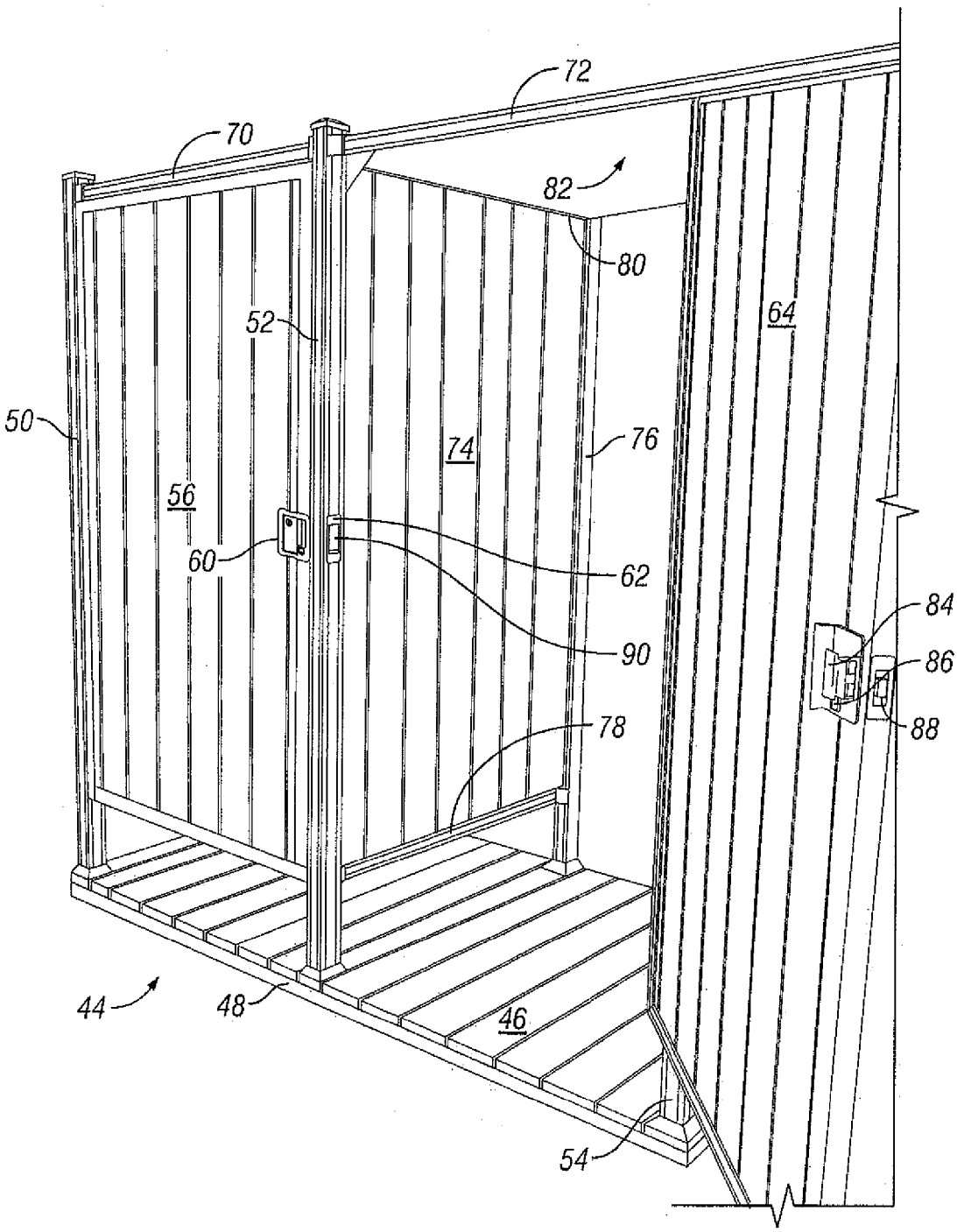
FIG. 3 is a perspective view of the outdoor shower enclosure shown in FIG. 2, with one of the doors open.

FIG. 3 shows the example enclosure 42 with the second door 64 in an open position. In this view, a wall panel 74 is disposed between the second post 54 and a fourth post 76. The wall panel 74 allows multiple persons to use a first stall and a second stall in privacy. As discussed below, embodiments are also contemplated in which the wall panel 74 extends only a portion of the way between the second post 52 and the fourth post 76. In this example, the wall panel 74 is held in place by a bottom rail 78 and a top rail 80. In this view, a ceiling area 82 can also be seen. In some embodiments, the ceiling area 82 may include louvers or could be covered with a transparent or translucent material or other suitable materials. This view also shows an interior latch 84 that may be used to open and close the second door 64 while within the stall. In the embodiment shown, a locking mechanism 86 actuates a deadbolt 88 that is received by an opening 90 in the spacer 62.

Figure 4:
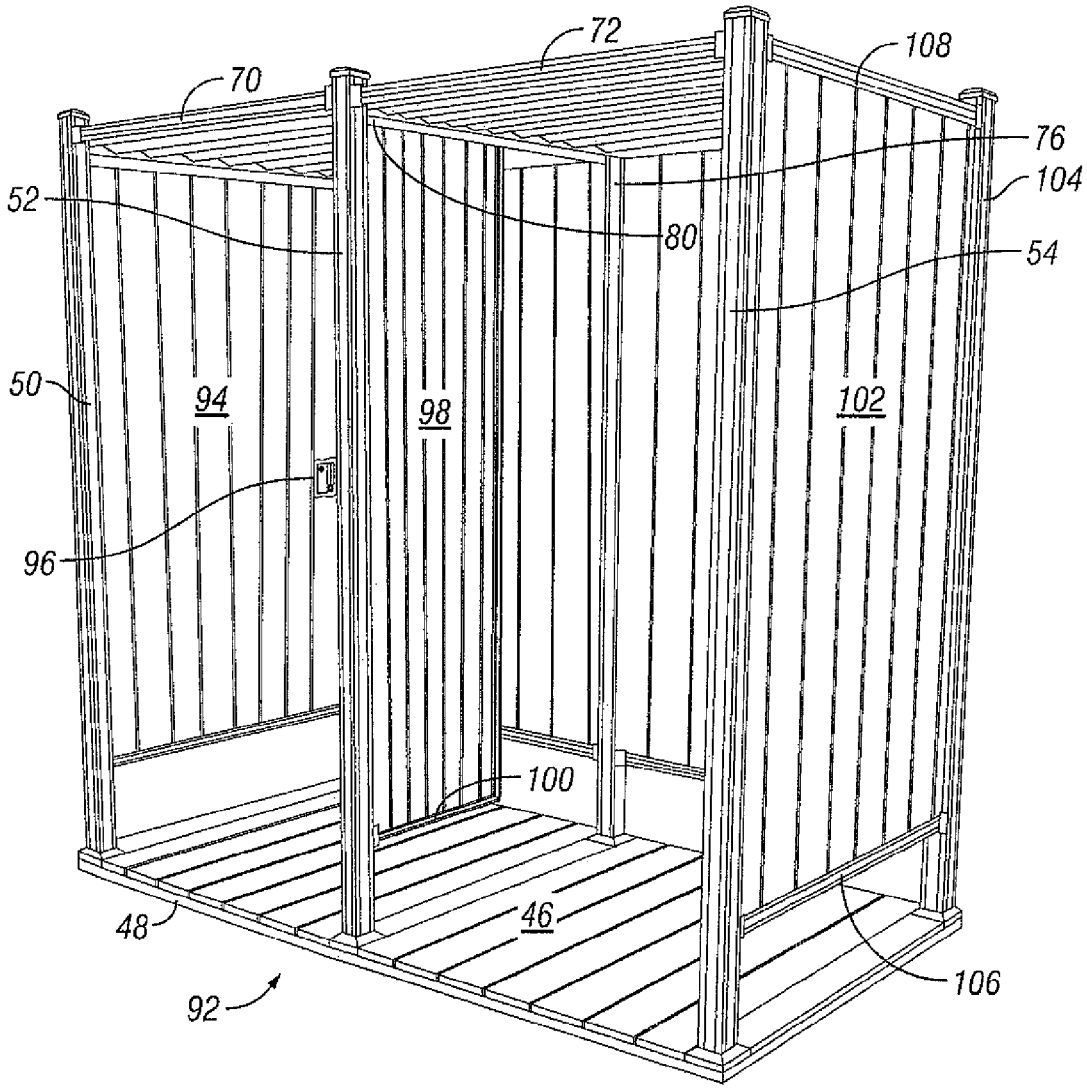
FIG. 4 is a perspective view of an outdoor shower enclosure according to an embodiment of the invention.

FIG. 4 shows an enclosure 92 according to an alternative embodiment.

The frame structure of this embodiment is similar to that shown in FIGS. 2 and 3. As discussed above, the placement of doors, wall panels, half wall panels, or other structures are highly configurable with the enclosure according to the present invention, since the dimensions between posts are substantially the same in some embodiments. This allows doors and panels to be interchangeably mounted between the posts to have a highly configurable enclosure.

In the example shown in FIG. 4, a door 94 is pivotally mounted between the first post 50 and another post (not shown) to provide access to a stall. An internal latch 96 is provided to lock the door 94 from within the stall. Although the door 94 is hinged to the first post 50 in the example shown in FIG. 4, the door 94 could be pivoted about the rear post (not shown) if desired. In this example, a half wall 98 is disposed between the second post 52 and the fourth post 76. In this example, the half wall 98 is mounted between a top rail 80 and a bottom rail 100. The half wall 98 defines a separation between the stalls without entirely preventing a user to move between the stalls. This type of arrangement may be beneficial if a shower were located in the first stall while the user's clothes and other items were in the second stall to prevent splashing into the second stall. This enclosure 92 also includes a side wall panel 102 disposed between the third post 54 and a fifth post 104. A bottom rail 106 and top rail 108 fix the position of the wall panel 102.

Figure 5:
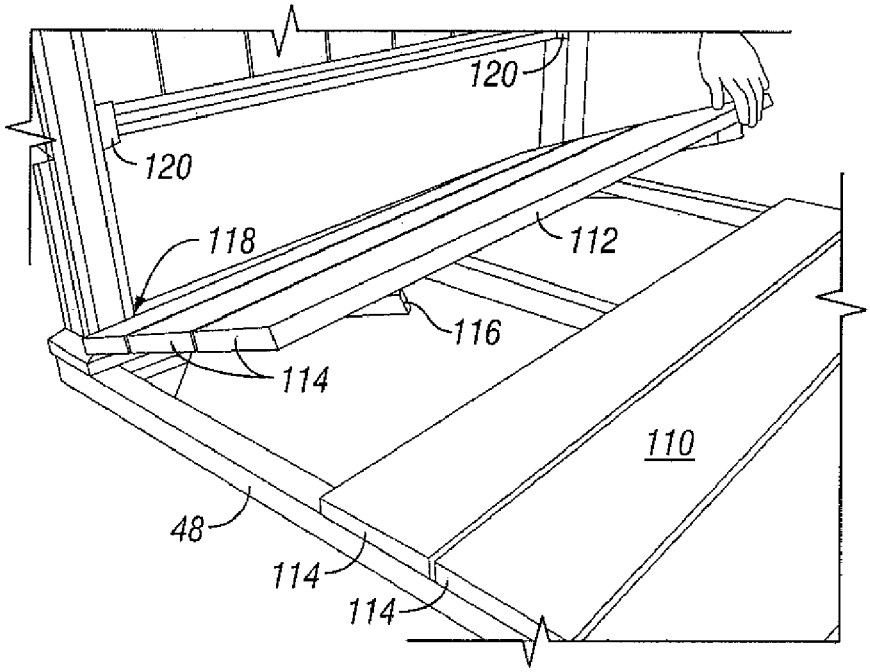
FIG. 5 is a detailed perspective view of the shower enclosure shown in FIG. 2, with a floor panel raised to show the floor structure.

FIG. 5 shows a detailed view of the floor 46 with a first section 110 resting on the base frame 48 and a second section 112 partially lifted above the base frame 48. In this example, the second section 112 includes a plurality of boards 114 that are connected together with a support member 116 to hold the boards in a spaced apart fixed position with respect to each other. As shown, a cutout portion 118 is provided to accommodate the post. Preferably, the floor sections are dimensioned so that a predetermined number, such as two floor sections, fit between posts. In this manner, the floor sections may be interchangeable. As discussed above, the floor sections are preferably made from a foamed vinyl, such as foamed PVC. With this material, the floor sections would be reduced maintenance and could withstand harsh outdoor climate conditions. FIG. 5 also shows the detail of a bracket 120 that may be used to hold a rail, such as a bottom rail, to support a wall panel.

Figure 6:
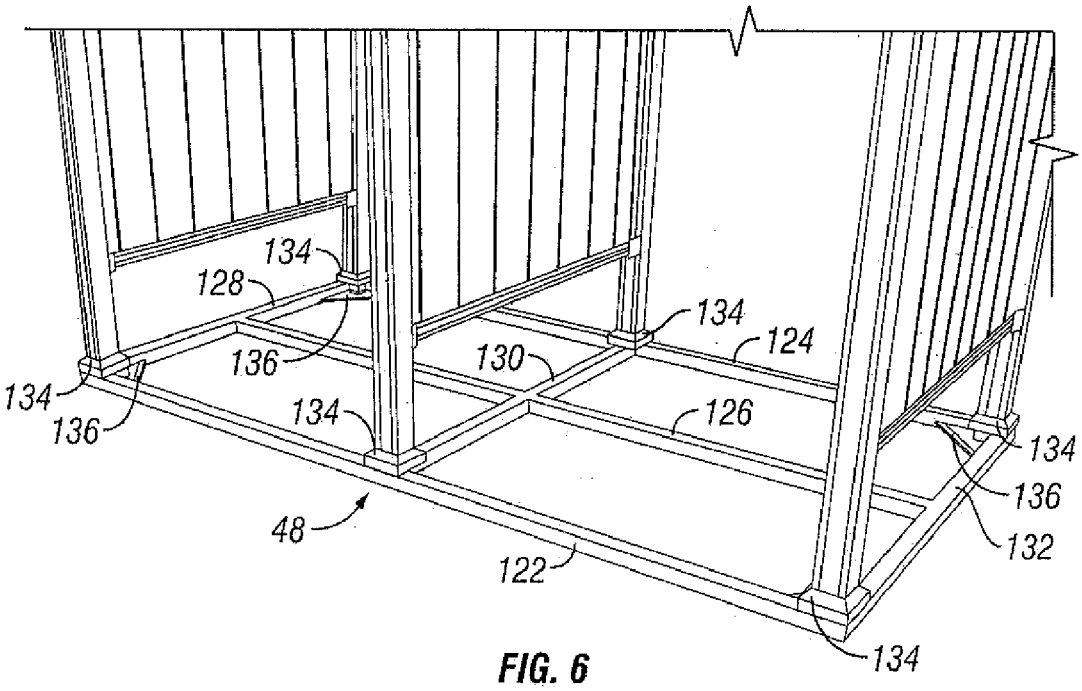
FIG. 6 is a detailed perspective view of the shower enclosure shown in FIG. 2 with the floor panels removed to show the base structure.

FIG. 6 shows a detailed view of the base frame 48 with the floor 46 removed. In the embodiment shown, the base frame 48 includes a first beam 122 spaced apart and approximately parallel with a second beam 124 with a third beam 126 disposed therebetween. On one end, a first transverse beam 128 connects the first beam 122, second beam 124, and third beam 126 together. A second transverse beam 130 and a third transverse beam 132 likewise connect the first, second, and third beams 122, 124, 126. As discussed below, the posts couple with a portion of the base frame 48. As shown, post flares 134 cover the fasteners used to couple the posts to the base frame. In this embodiment, support angles 136 provide additional structural support for the base frame 48 in the edges.

Figure 7:
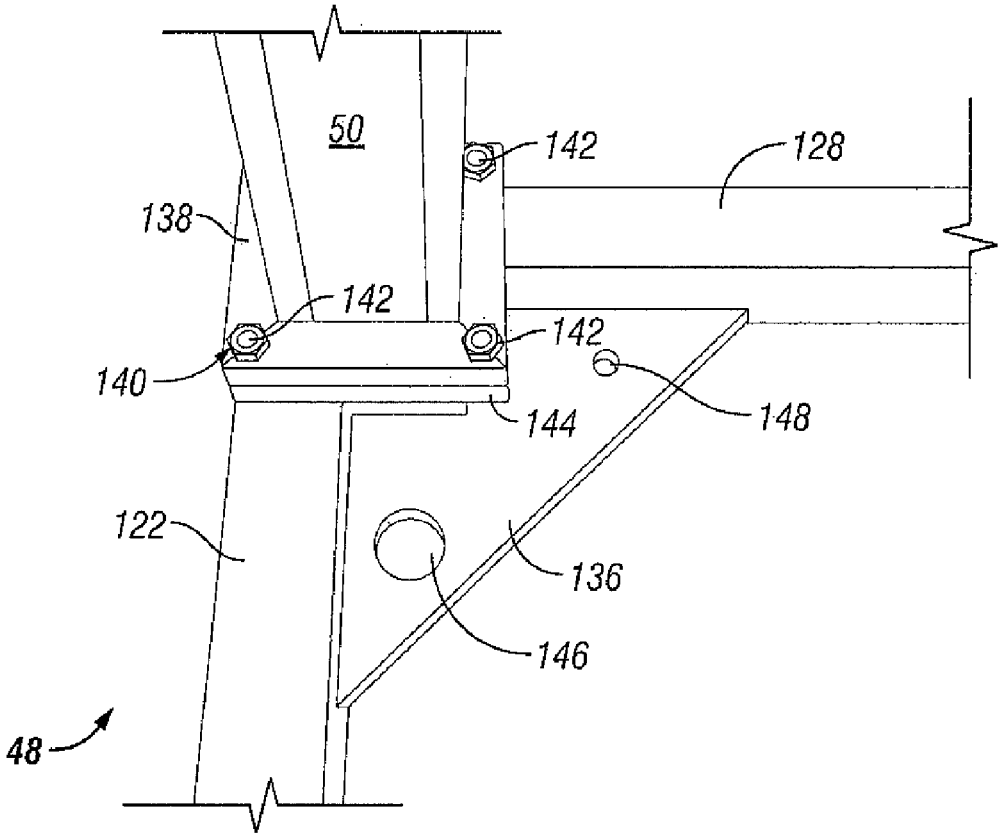
FIG. 7 is a detailed perspective view of an example corner support structure that could be used with the outdoor shower enclosure.

FIG. 7 shows a detailed view of an edge of the base frame 48 shown in FIG. 6 with the post flare 134 removed. In this example, the post 50 includes a flange 138 that defines holes 140 through which fasteners 142 may extend. A mounting plate 144 extends from the base frame 48 and has a similar dimension as the flange 138 of the post. In this example, bolts are used as the fastener, but other suitable fasteners could instead be used. In the example shown, a first hole 146 and a second hole 148 are defined in the support angle 136. As shown, the first hole 146 has a larger diameter than the second hole 148. With this arrangement, the first hole would be intended for mounting the base frame 48 to concrete, while the second hole 148 may be used for anchoring the base frame 48 into the ground.

Figure 8:
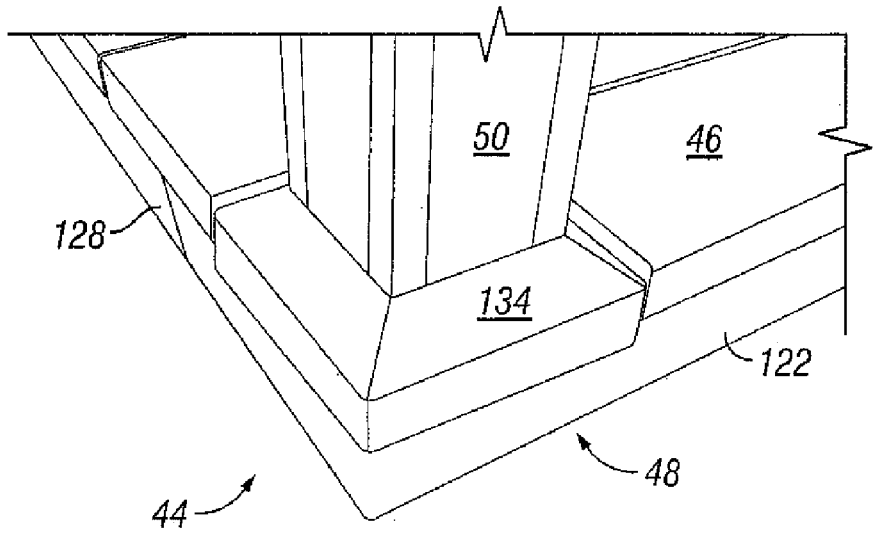
FIG. 8 is a detailed perspective view of an example corner support structure with a cap and floor panel installed.

FIG. 8 shows a detailed view of a corner of the base portion 44 with the floor 46 and post flare 134 installed. As discussed above, the post flare 134 hides the fasteners 142 from view to provide a more decorative look. Preferably, the post flares 134 are formed from powder coated aluminum or other suitable material for use in an outdoor climate.

Figure 9:
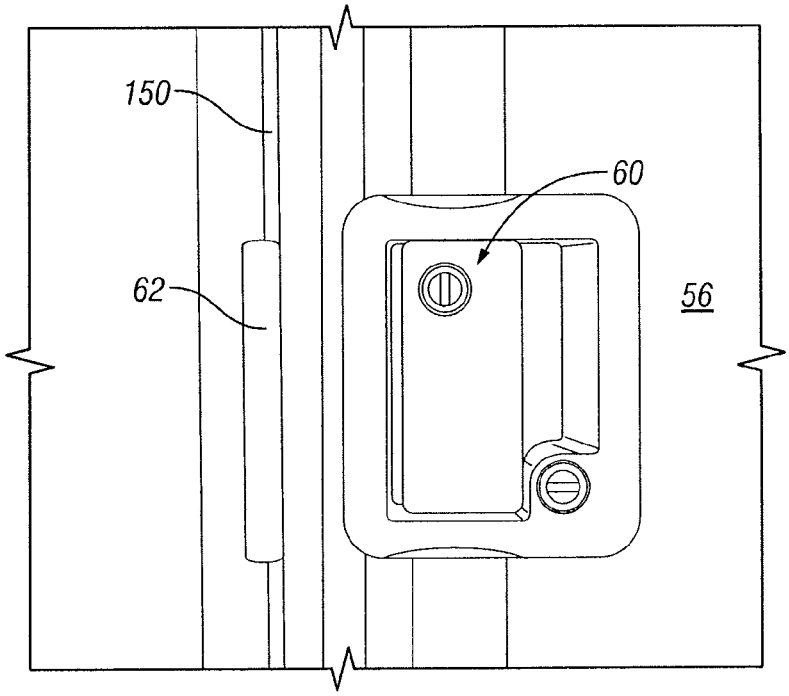
FIG. 9 is a detailed front view of an example outdoor shower enclosure's latch mechanism that could be used according to an embodiment of the invention.

FIG. 9 shows a detailed view of the latch 60 and spacer 62. In this embodiment, a filler member 150 is provided to block viewing through the opening created by the spacer 62 to provide complete privacy for the occupant of the stall.

Figure 10:
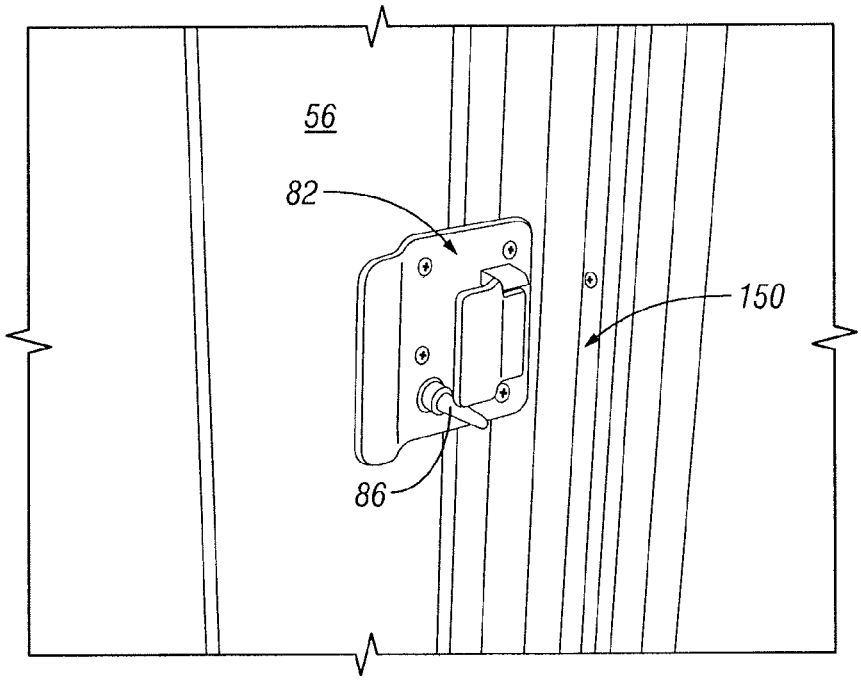
FIG. 10 is a detailed rear view of the example latch mechanism shown in FIG. 9.

FIG. 10 shows an interior of the enclosure 42 having the latch 82 with a locking mechanism 86. From this view, the filler member 150 is also visible.

Figure 11:
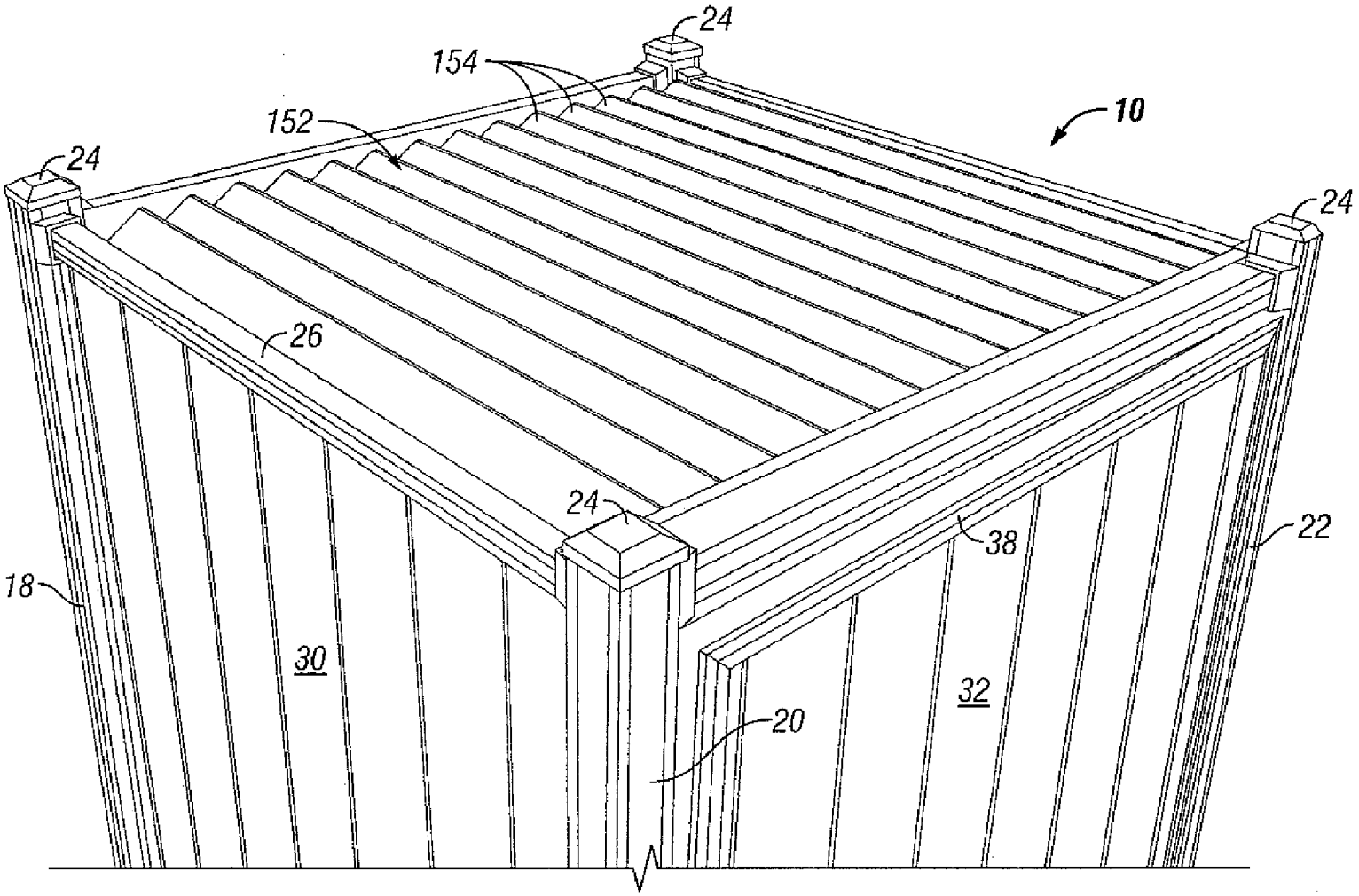
FIG. 11 is a detailed view of an outdoor shower enclosure's roof structure with a louver system in this example embodiment with a single stall.

FIG. 11 shows a detailed view of the roof portion 152 of the enclosure 10 described with respect to FIG. 1. In this embodiment, the roof portion 152 includes louvers 154 extending along an entire area of the enclosure's 10 entire top surface. In the embodiment with louvers 154, the user may move the louvers to a position that provides privacy from above, or to a more open position. The louvers 154 provide ventilation for the enclosure 10.

Figure 12:
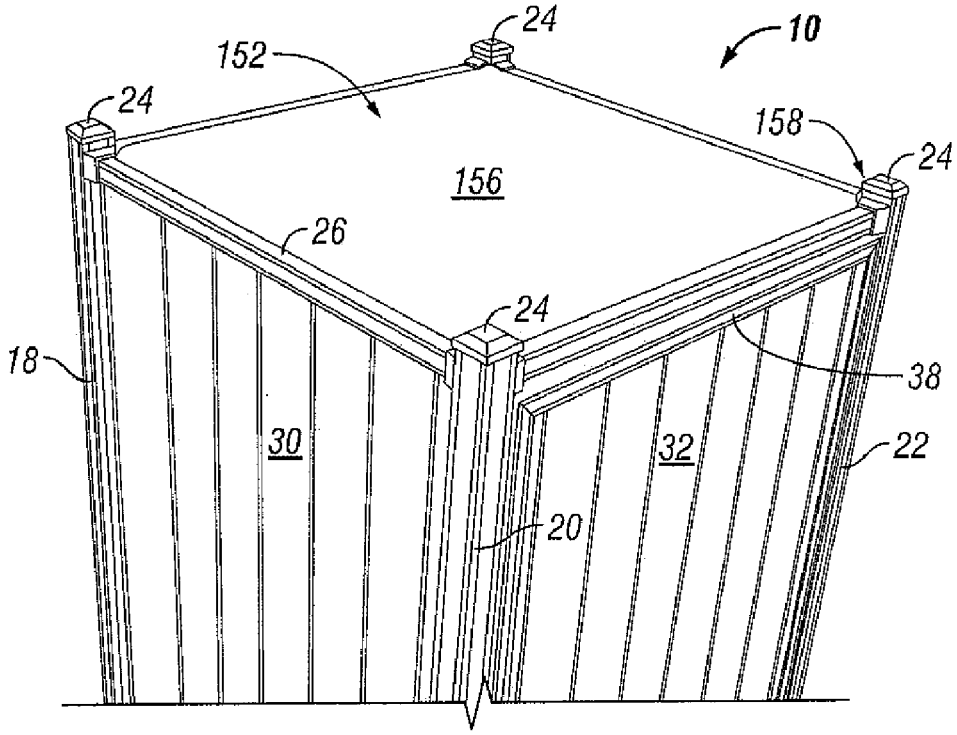
FIG. 12 is a detailed view of an outdoor shower enclosure's roof structure with a closed roof system in this example embodiment with a single stall.

FIG. 12 shows an embodiment of the enclosure 10 of FIG. 1 with a roof portion 152 formed from a translucent roof 156. In this embodiment, the translucent material, such as plexiglass, would allow light to illuminate the interior of the stall while providing privacy for the occupant. As shown, the corners of the roof 156 are angled to provide ventilation openings 158 for the enclosure 10.

Figure 13:
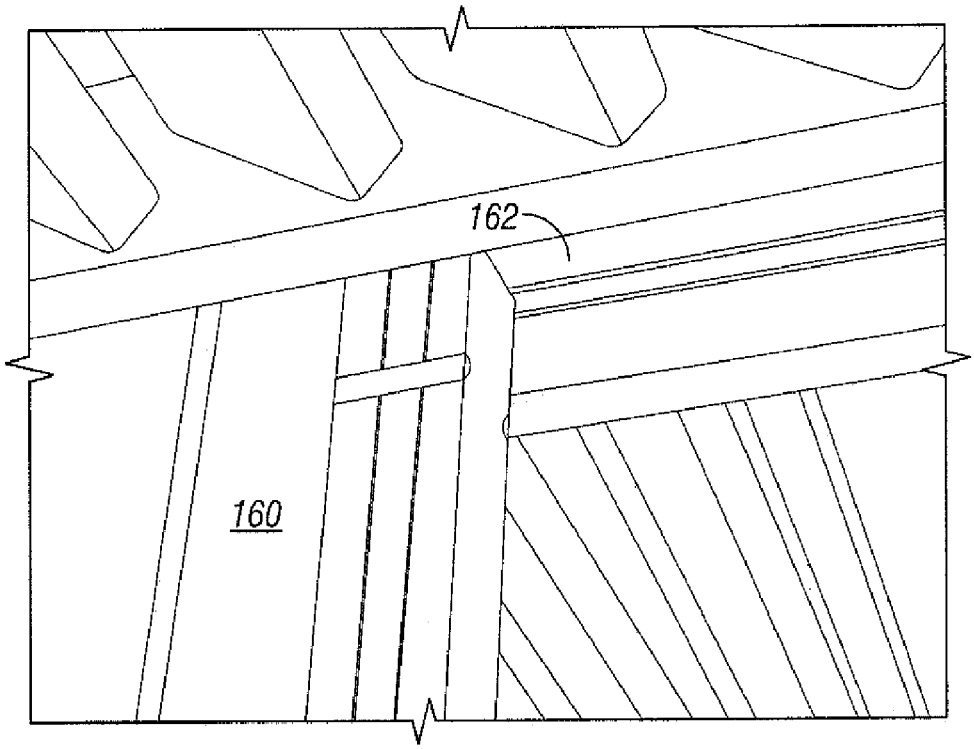
FIG. 13 is a detailed perspective view of a louvered roof for a double stall from inside the shower enclosure according to an example embodiment of the invention.

FIG. 13 is a detailed view showing a half wall 160 mounted to a top rail inside an enclosure. With this sort of arrangement, the fasteners, such as screws, are hidden from view to increase the esthetics of the enclosure.

Figure 14:
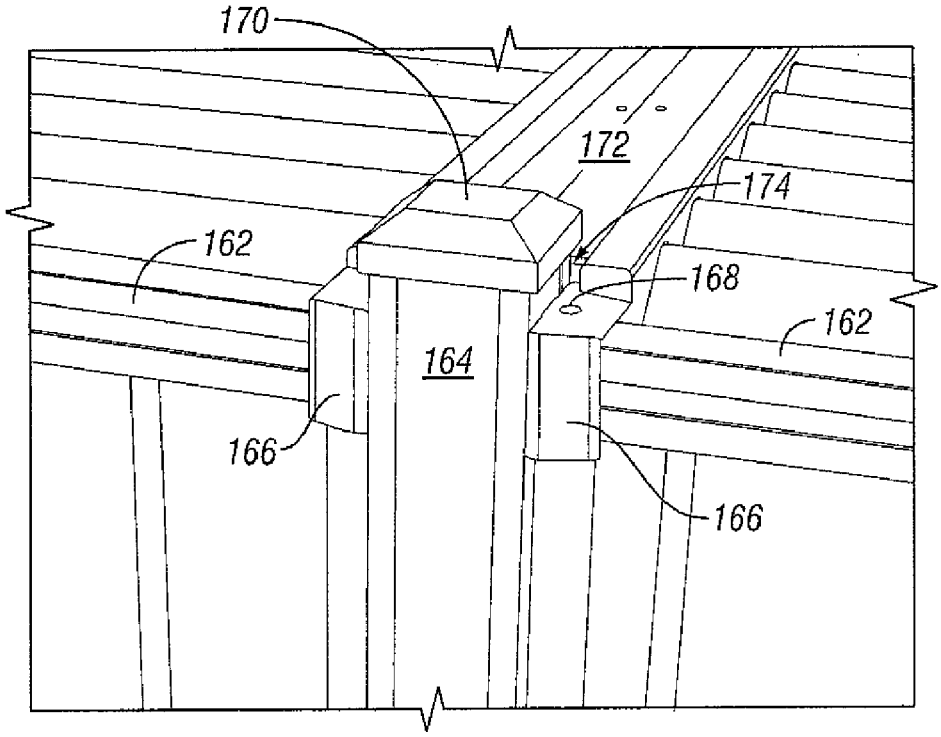
FIG. 14 is a detailed perspective view of the example roof structure shown in FIG. 13 from outside the shower enclosure.

FIG. 14 shows a detailed view of a roof area for an enclosure similar to that of FIG. 3. In this example, top rails 162 extend between a center post 164 and distal post (not shown). A cover 166 is provided at the intersection of the top rails 164, 162 and the center rail 164. As shown, a hole 168 is preformed in the covers to allow water to escape from the stalls. A post cap 170 is mounted on the top of the center post 164 to prevent water from entering the interior cavity of the center post 164. In this example, a seam 172 is provided to extend between the stalls. In this example, a ventilation port 174 between the center post 164 and the seam 172 allows water to escape from the stalls. Although this example shows an embodiment with louvers on the roof area, it should be appreciated that other roof portions, such as the transparent roof discussed above, could be provided.

Figure 15:
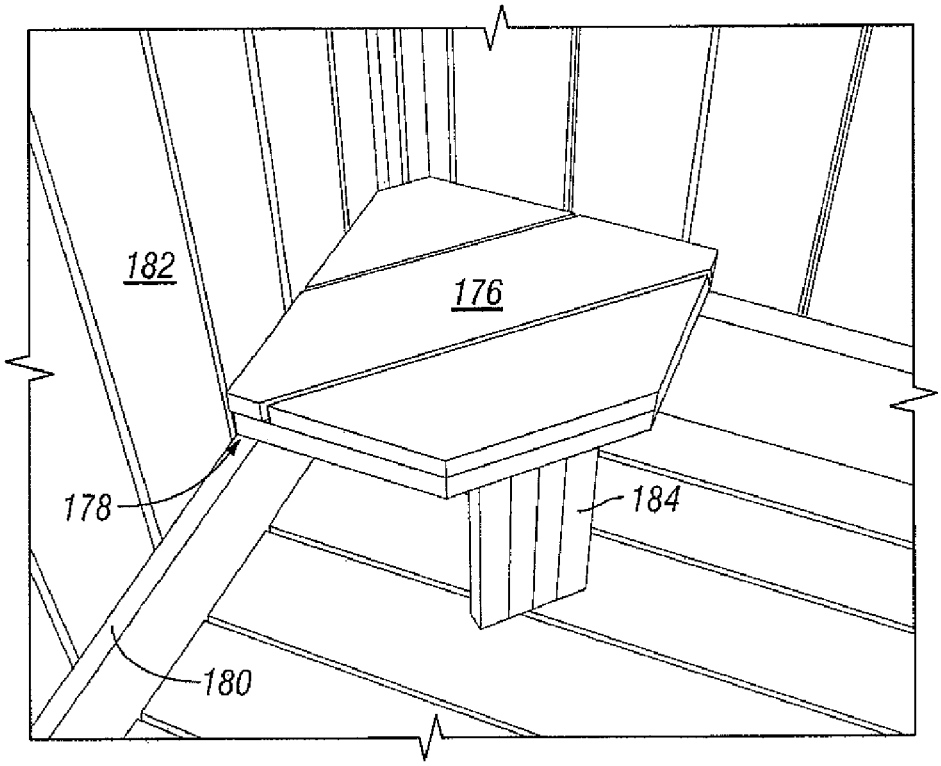
FIG. 15 is a perspective view of the inside of the outdoor shower enclosure showing an optional bench.

FIG. 15 shows an interior of an enclosure in which a bench 176 is provided. In this example, the bench is mounted in a corner of the stall. As shown, a flange 178 extends from the bench 176 to be received by a bottom rail 180, which also supports a wall panel 182. Although this embodiment shows a single leg 184 supporting the bench, it should be appreciated that multiple legs could be provided if the flange 178 was not mounted into the bottom rail 180. Preferably, the bench is formed from a foamed vinyl, such as foamed PVC.

Figure 16:
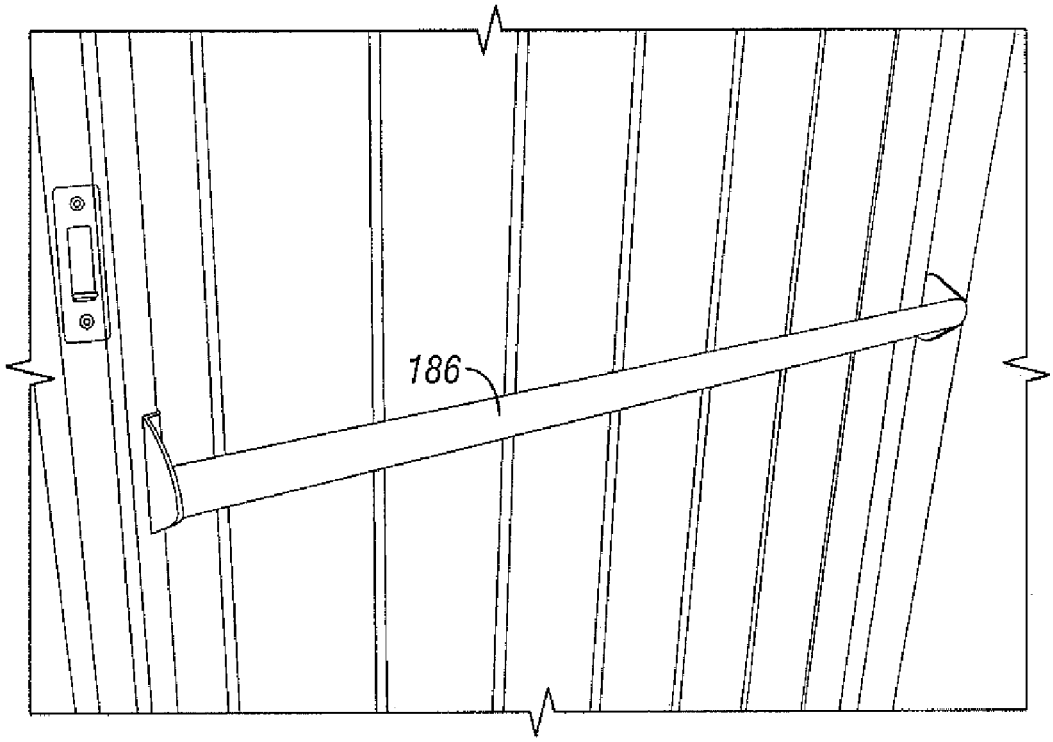
FIG. 16 is a perspective view of the inside of the outdoor shower enclosure showing an optional towel bar.
Figure 17:
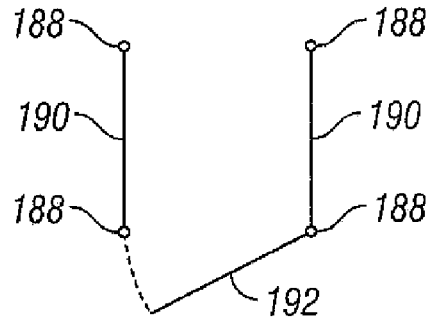
FIGS. 17-29 show schematic top views with various arrangements of the shower enclosure.
Figure 18:
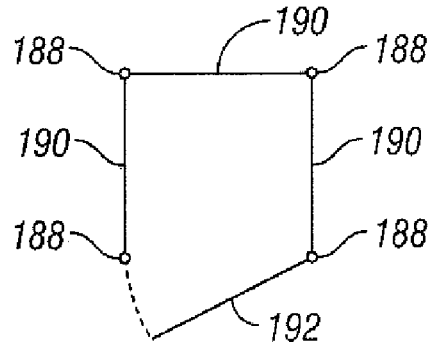
Figure 19:
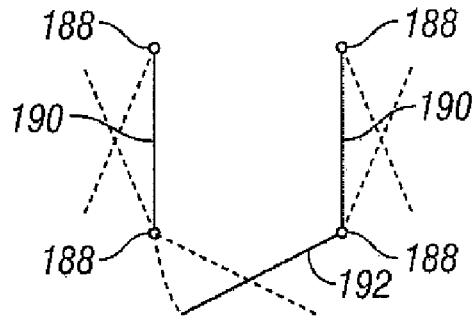
Figure 20:
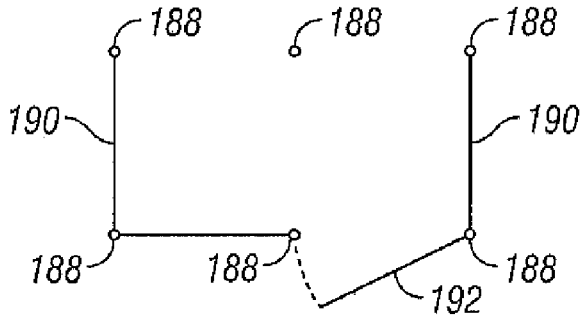
Figure 21:
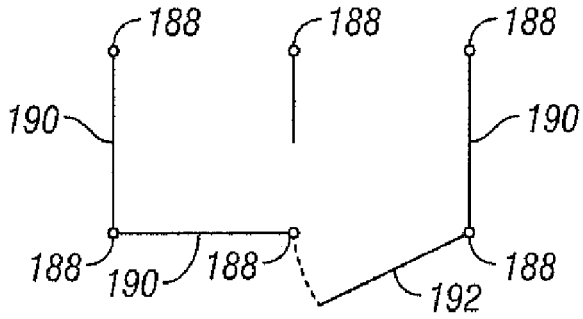
Figure 22:
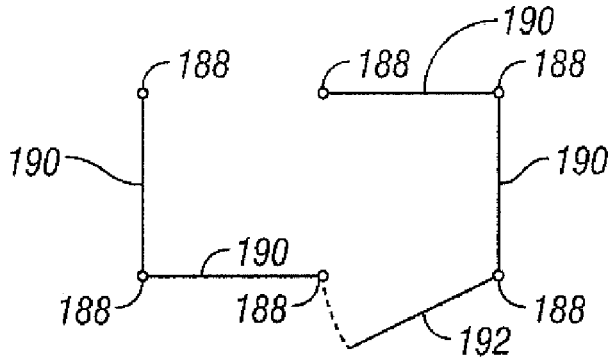
Figure 23:
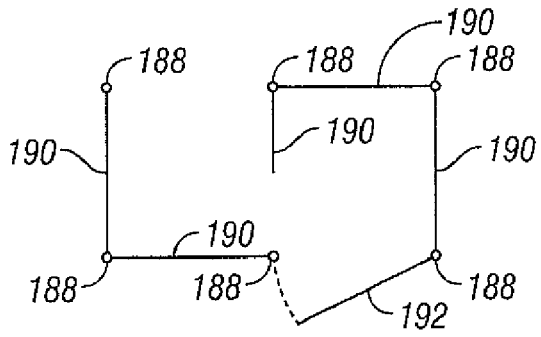
Figure 24:
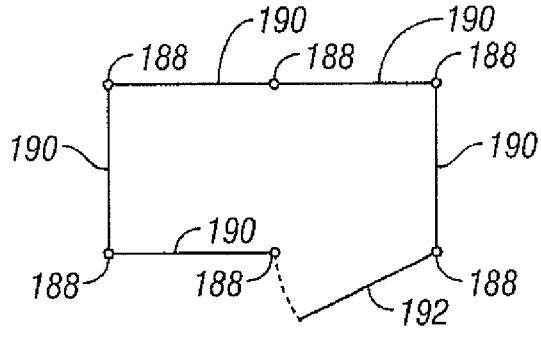
Figure 25:
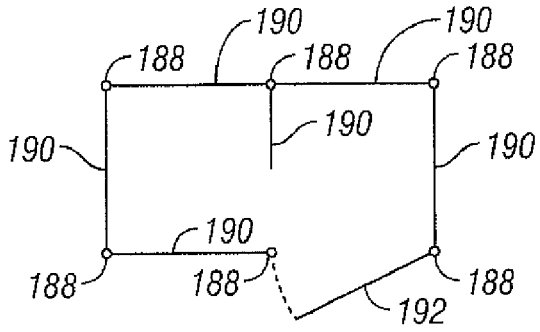
Figure 26:
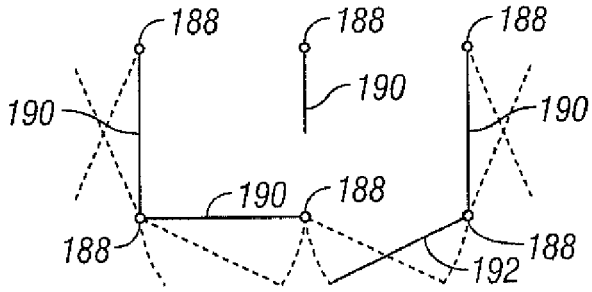
Figure 27:
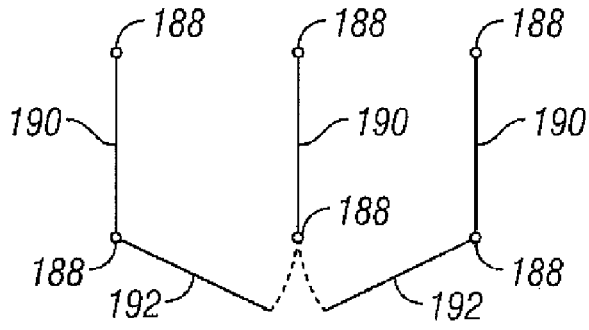
Figure 28:
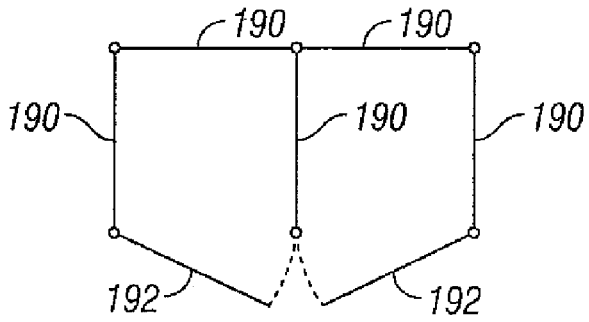
Figure 29:
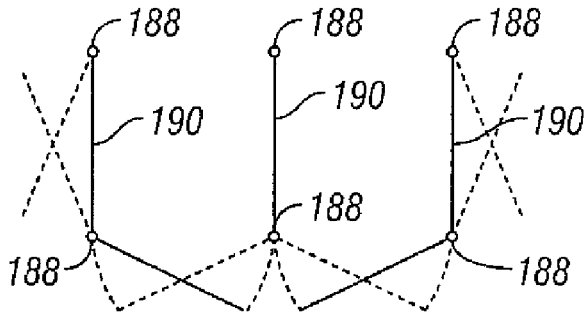

FIG. 16 shows an optional towel bar 186 that may be mounted either inside an enclosure or to an exterior portion of an enclosure. This allows the user to hang a towel while taking a shower or to hold clothes or other objects of the user.

FIGS. 17 through 29 show various example configurations that could be formed using the invention. As discussed above, the enclosures are highly configurable for a single or double stall, with doors or wall panels being mountable at any location between posts. Moreover, the removable wall portion allows the enclosure to be installed quickly and easily, as well as providing the configurability that a custom build would normally make necessary. In these figures, the schematical representation shows posts 188, wall panels (which could be half walls) 190, and doors 192.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An outdoor shower enclosure comprising:

a roof;

a base frame comprising a plurality of metal structural members connected together to define a peripheral edge with a plurality of mounting plates;

a plurality of substantially vertically extending support posts extending between the mounting plates and the roof, wherein the support posts are spaced apart approximately equidistant from each other along the peripheral edge;

a plurality of vinyl wall panels disposed between the posts;

at least one vinyl floor panel carried by the base frame; and wherein the floor panel includes at least one cut-out portion that is dimensioned to receive at least a portion of one or more posts.

2. The outdoor shower enclosure of claim 1, wherein the mounting plates include a predefined hole to receive a fastener for attaching the posts to the mounting plates.

3. The outdoor shower enclosure of claim 1, wherein the floor panel includes at least one elongated support member configured to reduce lateral movement with respect to the base frame.

4. The outdoor shower enclosure of claim 1, wherein the roof includes a translucent portion.

5. The outdoor shower enclosure of claim 1, wherein the roof includes a louvered portion.

6. The outdoor shower enclosure of claim 1, wherein at least one laterally mounted wall panel extends between the base frame and the roof to define at least two rectangular parallelepiped shower stalls.

7. The outdoor shower enclosure of claim 6, wherein the base frame includes a side with at least three mounting plates.

8. The outdoor shower enclosure of claim 1, wherein the wall panels are PVC panels.

9. The outdoor shower enclosure of claim 1, further comprising at least one door mountable between the support posts.

10. The outdoor shower enclosure of claim 6, further comprising a first door mountable between the support posts and positioned to allow access to one of the at least two shower stalls and a second door mountable between the support posts and positioned to allow access to another of the at least two shower stalls.

* * * * *